US006309725B1

(12) United States Patent
Peterson et al.

(10) Patent No.: US 6,309,725 B1
(45) **Date of Patent: *Oct. 30, 2001**

(54) SEGMENTED ROLL PRODUCT FOR ENHANCED COHESIVE

(75) Inventors: Wayne C. Peterson, Manchester, NH (US); Terry Cannon, St. George, UT (US)

(73) Assignee: Moore U.S.A. Inc., Grand Island, NY (US)

( * ) Notice: Subject to any disclaimer, the term of this patent is extended or adjusted under 35 U.S.C. 154(b) by 36 days.

This patent is subject to a terminal disclaimer.

(21) Appl. No.: 09/620,139

(22) Filed: Jul. 20, 2000

Related U.S. Application Data

(63) Continuation of application No. 09/160,195, filed on Sep. 25, 1998.

(51) Int. Cl.[7] ..... B65D 65/28; B65D 85/66; B65D 27/10; B65D 27/00

(52) U.S. Cl. ..... 428/43; 428/906; 206/390; 229/69; 229/92.1

(58) Field of Search ..... 428/43, 906; 206/390; 229/69, 92.1

(56) References Cited

U.S. PATENT DOCUMENTS

| | | | | |
|---|---|---|---|---|
| 3,325,188 | | 6/1967 | Hiersteiner | 229/69 |
| 5,046,661 | * | 9/1991 | Kimura | 229/92.1 |
| 5,174,491 | | 12/1992 | Taylor et al. | 229/92.1 |
| 5,174,493 | | 12/1992 | File | 229/301 |
| 5,193,850 | * | 3/1993 | Lombardo | 281/2 |
| 5,238,178 | | 8/1993 | Hutchinson et al. | 229/92.1 |
| 5,253,798 | | 10/1993 | Lombardo | 229/92.1 |
| 5,294,041 | | 3/1994 | Whiteside | 229/69 |
| 5,346,123 | | 9/1994 | Lombardo | 229/305 |
| 5,376,048 | | 12/1994 | Whiteside | 462/6 |
| 5,785,242 | | 7/1998 | Lombardo | 229/305 |
| 5,829,670 | * | 11/1998 | Lombardo et al. | 229/92.1 |
| 5,950,909 | * | 9/1999 | Peterson et al. | 229/92.1 |

* cited by examiner

*Primary Examiner*—Harold Pyon
*Assistant Examiner*—Michael C. Miggins
(74) *Attorney, Agent, or Firm*—Nixon & Vanderhye PC

(57) ABSTRACT

A Z-fold mailer type business form intermediate using patterns of pressure activated cohesive has the cohesive in patterns for both sealing along the end and side edges of the final form in the form of discrete elements spaced from each other in such a way that when the business form is in either roll or stack format the individual cohesive elements substantially do not overlap each other. The cohesive elements typically are in the form of rectangles for example those along the end edges and the fold lines having a length of about 0.9 cm with space in between them of about 1.3 cm. The cohesive patterns along the side edges may be spaced from each other not only in a dimension parallel to the end edges, but also where cohesive patterns are provided on opposite faces of the second panel of the intermediate, they may be positioned so as not to overlap in a dimension parallel to the side edges.

18 Claims, 3 Drawing Sheets

SEGMENTED ROLL PRODUCT FOR ENHANCED COHESIVE

This is a continuation of application Ser. No. 09/160,195, filed Sep. 25, 1998, now pending, the entire content of which is hereby incorporated by reference in this application.

BACKGROUND AND SUMMARY OF THE INVENTION

Copending U.S. Pat. Nos. 5,829,670, 5,950,909, and 5,785,242 (the disclosures of which are hereby incorporated by reference) show the desirability of providing particular configurations of pressure activated cohesive. The pressure activated cohesive utilizable in these applications, and according to the invention, is preferably of the type such as sold commercially by Toppan Forms of Japan under the trade designation TN124, a styrene-natural rubber copolymer, and such as also disclosed in U.S. Pat. Nos. 4,918,128, 5,190,818, 5,314,944 and 5,427,851, and such as shown in U.S. pending application Ser. No. 09/507,932 filed Feb. 22, 2000, entitled Pressure Sensitive Cohesive Composition, the disclosures of which are hereby incorporated by reference herein.

According to the present invention, a business form intermediate is provided with particular positioning of the patterns of pressure activated cohesive so as to substantially preclude the cohesive patterns sticking to each other when the intermediates are in roll or stack (e.g. pad refolding) configuration prior to forming the final mailers, such as using Moore SpeediSealer® equipment, available from Moore U.S.A. of Lake Forest, Ill. The mailer type business form intermediates according to the invention are particularly for Z-fold forms. The Z-fold form intermediates according to the invention provide a pressure activated cohesive in the form of spaced discrete elements which are shaped, dimensioned, and positioned so that the cohesive elements substantially do not overlap (engage) each other when in roll or stack (including pad refolding) configuratoins. This allows a maximum strength cohesive to be utilized so that the holding power of each of the individual discrete elements of cohesive is sufficient to provide effective sealing of the form, as opposed to mere tacking.

According to one aspect of the present invention a Z-fold mailer type business form intermediate is provided comprising the following components: A sheet or web of paper having first and second faces, first and second end lines substantially parallel to each other, and first and second side lines substantially parallel to each other and substantially perpendicular to the first and second end lines. First and second fold lines extending substantially parallel to each other and to the end lines for dividing the sheet or web between the end lines, into first, second and third panels. First and second lines of weakness spaced from but adjacent and substantially parallel to the first and second side lines, defining first and second tear-off edges in a mailer produced from the intermediate. A first pattern of pressure activated cohesive comprising spaced distinct sealing elements disposed adjacent the first end line on the first face, and a second pattern which cooperates with the first pattern when the intermediate is Z-folded about the fold lines to form a mailer. The second pattern disposed adjacent the second fold line on the first face. A third pattern of pressure activated cohesive comprising spaced distinct sealing elements disposed adjacent the second end line of the second face and a fourth pattern which cooperates with the third pattern when the intermediate is Z-folded about the fold lines to form a mailer, the fourth pattern disposed adjacent the first fold line on the second face. The first and second pattern elements shaped and dimensioned and positioned with respect to the third and fourth pattern elements so that they substantially do not overlap in roll or stack form. Typically outgoing address indicia (both human readable and machine readable) is on (having been imaged on either using a printer or some other imaging technique) the third panel first face. Fifth and sixth patterns of pressure activated adhesive each comprising spaced distinct sealing elements disposed adjacent the first and second lines of weakness respectively in the tear-off edges on the first face and positioned so that the elements thereof cooperate with each other when the intermediate is Z-folded about the fold lines. Seventh and eighth patterns of pressure activated adhesive each comprising spaced distinct sealing elements disposed adjacent the first and second lines of weakness respectively on the second face and positioned so that the elements thereof cooperate with each other when the intermediate is Z-folded about the fold lines. And the fifth and seventh, and the sixth and eighth, patterns positioned and spaced from each other in a dimension substantially parallel to the end edges, and so that the patterns substantially do not overlap in roll or stack form.

Typically at least the majority of, and preferably all, of the elements are rectangular in shape having a length and a width, and the elements in the second through fourth patterns are spaced from each other a distance greater than the length (but not so much greater as to interfere with the sealing capability thereof). Typically the elements in at least some of the fifth through eighth patterns are spaced from each other a distance greater than the length of the elements in those patterns.

The end lines may be end edges, and the intermediate second side line may be joined with a second intermediate, that is there may be a "two up" configuration of intermediates. The end and side lines may both be end and side edges, and eventually are at some stage during production, while the end lines are typically lines of weakness during at least early stages of production when the intermediates are in a continuous web format.

The fifth and sixth patterns are typically provided in the first and second panel tear-off edges and the seventh and eighth patterns in the second and third panel tear-off edges. Also, typically the fifth and sixth, or seventh and eighth, patterns are substantially immediately adjacent the first and second lines of weakness whereas the others are spaced from the first and second lines of weakness a dimension greater than the width of the elements immediately adjacent the lines of weakness.

The intermediate according to the invention may be used in both uniform Z-fold and eccentric Z-fold configurations, and the term "Z-fold" encompasses both. In a uniform Z-fold configuration, the first, second and third panels all have substantially the same dimensions, while in an eccentric Z-fold configuration at least one of the panels has at least a first dimension (along the side edges of the intermediate) different than at least one of the other panels. Therefore, when the first through fourth panels are recited as "adjacent" a particular line or edge, it is to be understood that they need not necessarily be immediately adjacent, and will not be if they are associated with an eccentric Z-fold configuration.

Typically, the elements of the first through fourth patterns each have substantially the same length dimension substantially parallel to the end lines; and wherein the elements are spaced from each other in the direction of the length dimension a distance slightly greater than the length dimension but not so much greater so as to preclude effective sealing. The elements of the first through fourth patterns typically have a length dimension of between about 0.8–1 cm (e.g. about 0.9 cm), and a spacing of between about 1.2–1.5 cm (e.g. about 1.3 cm). Typically the elements of one of the first and second patterns, and third and fourth patterns, has a width dimension of about 0.1 cm greater (e.g. a width dimension of about 0.5 cm compared to 0.3 cm) than the other of the first and second patterns; and third and fourth patterns; typically the second or fourth pattern elements having a width dimension of at least about 0.1 cm greater than the first and third pattern elements.

According to another aspect of the present invention a Z-fold mailer type business form intermediate is provided comprising the following components: A sheet or web of paper having first and second faces, first and second end lines substantially parallel to each other, and first and second side lines substantially parallel to each other and substantially perpendicular to the first and second end lines. First and second fold lines extending substantially parallel to each other and to the end lines for dividing the sheet or web between the end lines, into first, second and third panels. First and second lines of weakness spaced from but adjacent and substantially parallel to the first and second side lines, defining first and second tear-off edges in a mailer produced from the intermediate. A first pattern of pressure activated cohesive comprising spaced distinct sealing elements disposed adjacent the first end line on the first face, and a second pattern which cooperates with the first pattern when the intermediate is Z-folded about the fold lines to form a mailer. The second pattern disposed adjacent the second fold line on the first face. A third pattern of pressure activated cohesive comprising spaced distinct sealing elements disposed adjacent the second end line of the second face and a fourth pattern which cooperates with the third pattern when the intermediate is Z-folded about the fold lines to form a mailer, the fourth pattern disposed adjacent the first fold line on the second face. The first and second pattern elements shaped and dimensioned and positioned with respect to the third and fourth pattern elements so that they substantially do not overlap in roll or stack form. The elements of the first through fourth patterns each having substantially the same length dimension substantially parallel to the end lines. And wherein the elements are spaced from each other in the direction of the length dimension a distance slightly greater than the length dimension but not so much greater so as to preclude effective sealing when the intermediate is Z-folded about the fold lines to form a mailer. The details of the individual components preferably are as described above.

According yet another aspect of the present invention, a Z-fold mailer type business form intermediate is provided comprising the following components: A sheet or web of paper having first and second faces, first and second end lines substantially parallel to each other, and first and second side lines substantially parallel to each other and substantially perpendicular to the first and second end lines. First and second fold lines extending substantially parallel to each other and to the end lines for dividing the sheet or web between the end lines, into first, second and third panels. First and second lines of weakness spaced from but adjacent and substantially parallel to the first and second side lines, defining first and second tear-off edges in a mailer produced from the intermediate. Fifth and sixth patterns of pressure activated adhesive each comprising spaced distinct sealing elements disposed adjacent the first and second lines of weakness respectively in the tear-off edges on the first face and positioned so that the elements thereof cooperate with each other when the intermediate is Z-folded about the fold lines. Seventh and eighth patterns of pressure activated adhesive each comprising spaced distinct sealing elements disposed adjacent the first and second lines of weakness respectively on the second face and positioned so that the elements thereof cooperate with each other when the intermediate is Z-folded about the fold lines. The fifth and seventh, and the sixth and eighth, patterns positioned and spaced from each other in a dimension substantially parallel to the end edges, and so that the patterns substantially do not overlap in roll or stack form. Wherein the fifth and sixth, or seventh and eighth, patterns are substantially immediately adjacent the first and second lines of weakness whereas the others are spaced from the first and second lines of weakness a dimension greater than the width of the elements immediately adjacent the lines of weakness. And wherein the elements on the opposite faces of the second panel are spaced from each other in the dimension of the side lines.

It is a primary object of the present invention to provide a Z-fold mailer type business form intermediate which can be provided in roll or stack form without the pressure activated cohesive elements thereof significantly engaging each other so that sticking of various portions of the roll or stack together, with corresponding processing difficulties, do not occur. This and other objects of the invention will become clear from an inspection of the detailed description of the invention and from the appended claims.

DETAILED DESCRIPTION OF THE DRAWINGS

Figure 1:
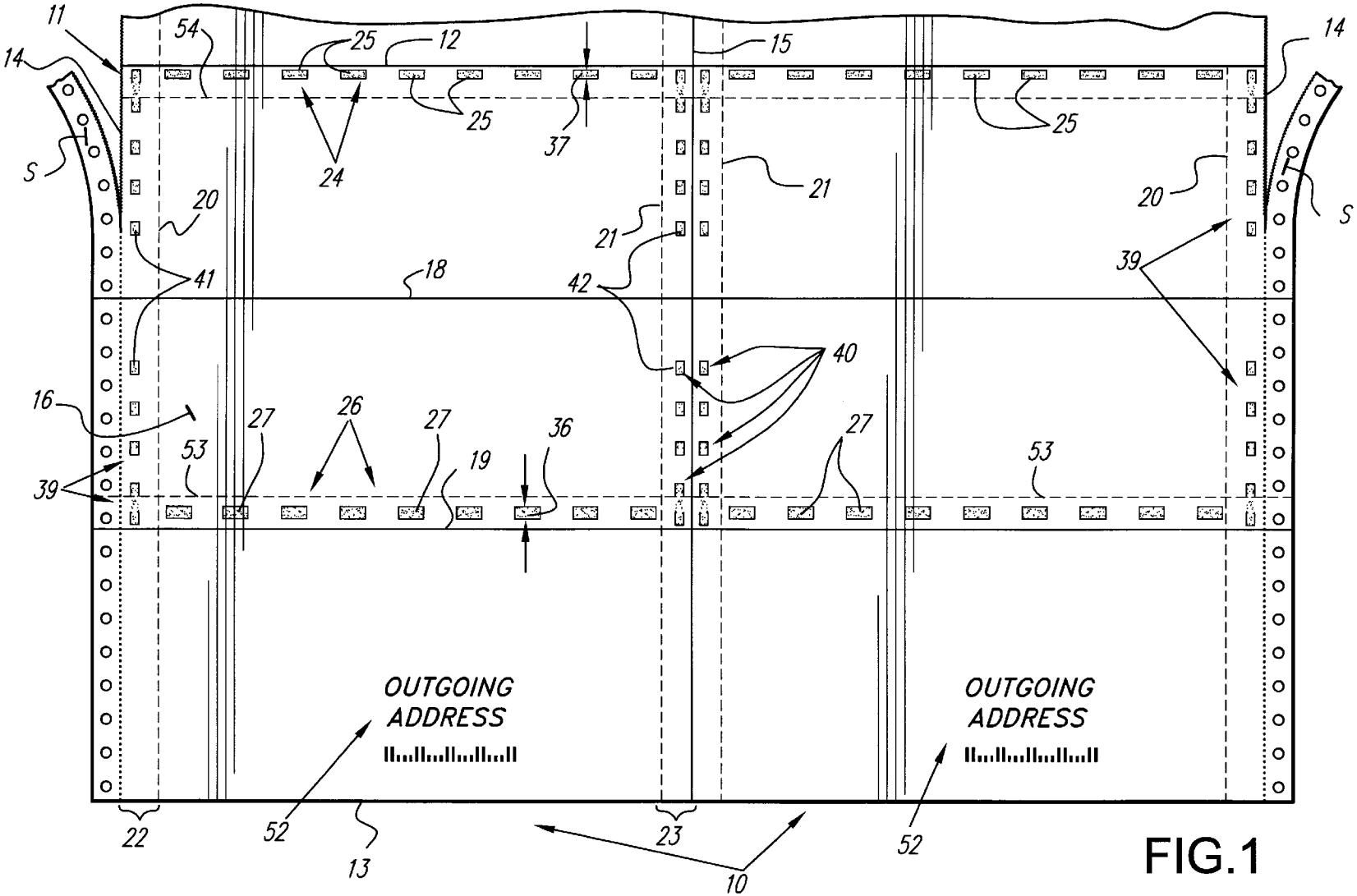
FIG. 1 is a top plan view of a first face of a two-up configuration of business form intermediates according to the present invention.
Figure 2:
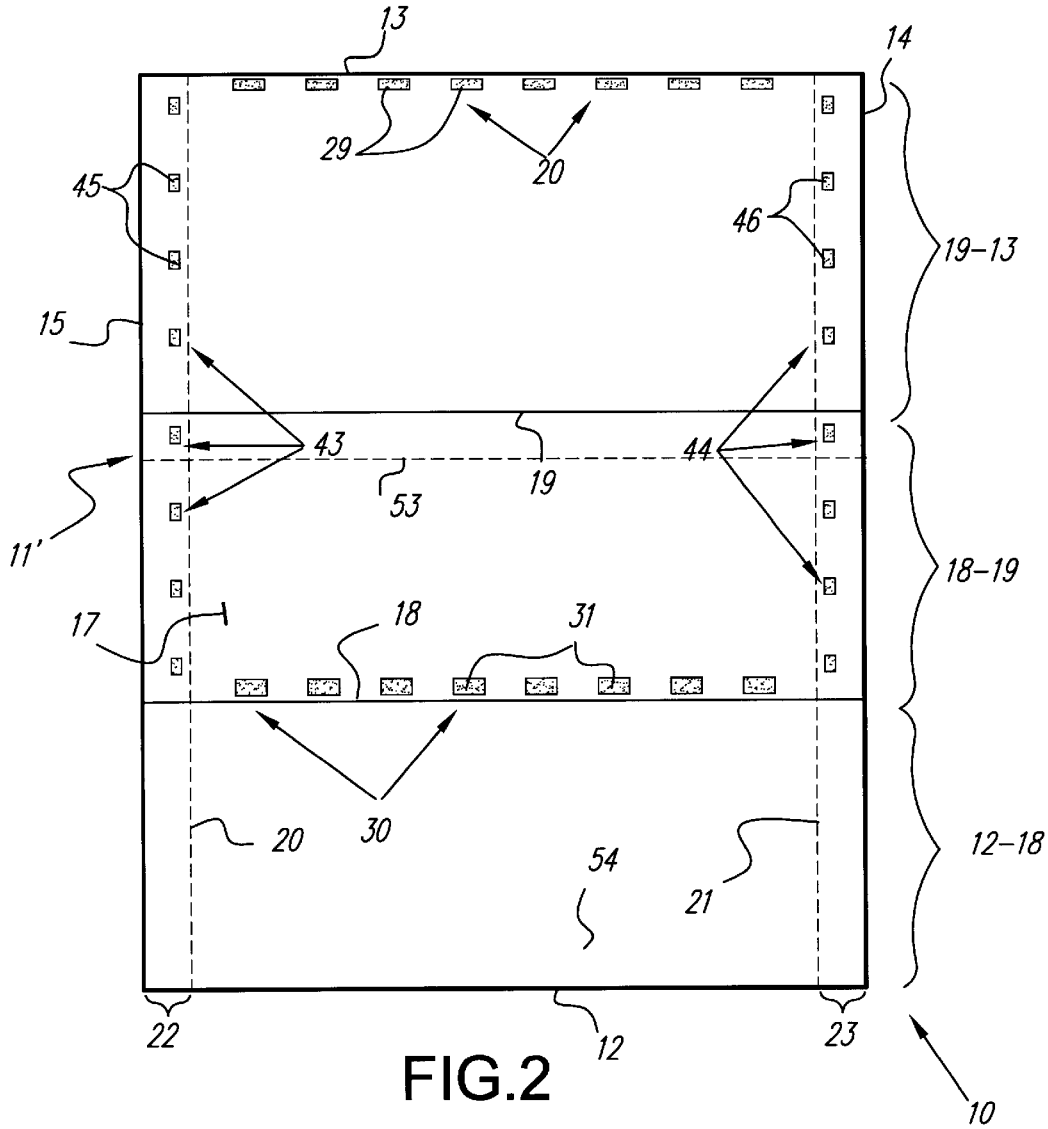
FIG. 2 is a top plan view of a second face of one of the intermediates of FIG. 1 with tractor drive strips removed.

A Z-fold mailer type business form intermediate is shown generally by reference numeral 10 in the drawings. An intermediate is made from a sheet or web of paper 11, 11', a web 11 being shown in FIG. 1 while a sheet 11' is shown in FIG. 2. Typically, at some stage during processing the intermediates 10 are in continuous web format and at some stage during processing they are separated into the individual sheets 11' of FIG. 2.

Each intermediate 10 includes first and second end lines 12, 13 substantially parallel to each other, and first and second side lines 14, 15 substantially parallel to each other and substantially perpendicular to the end lines 12, 13. The sheet or web 11, 11' also has a first face 16 (FIG. 1) and a second face 17 (FIG. 2). At some stage during processing the end lines 12, 13 are lines of weakness joining the intermediate 10 with like intermediates on either side thereof, but at another stage of processing ultimately the end lines 12, 13 are end edges as seen in FIG. 2. Also, typically at one stage of processing the side lines 14 are merely slit lines at which tractor drive strips S (see FIG. 1) are integral with the rest of the web 11, whereas the side lines 15 of side-by-side (two up) intermediates 10 are also integral, but eventually during processing slitting is practiced so as to remove the tractor drive strips S and to separate the intermediates 10 along the common side line 15 thereof (see FIG. 1) so as to form individual sheets 11', as is conventional.

The intermediate 10 also comprises first and second fold lines 19, 20 which are substantially parallel to the end lines 12, 13 and form the intermediate 10 into three panels. As illustrated in FIG. 2, the first panel is the end panel 12-18, the second panel is the intermediate panel 18-19, and the third panel is the opposite end panel 19-13. Where the mailer type business form produced from the intermediate 10 is a uniform Z-fold, the panels 12-18, 18-19, 19-13 have substantially the same dimensions, however, if the business produced from the intermediate 10 is an eccentric Z-fold, at least one of the panels 12-18, 18-19, 19-13 will have different dimensions (particularly a dimension parallel to the side lines 14, 15) than at least one of the other panels.

The intermediate 10 also comprises first and second lines of weakness 20, 21 spaced from but adjacent and substantially parallel to the first and second side lines 14, 15, defining first and second tear-off edges 22, 23 in a mailer produced from the intermediate 10. The lines of weakness 20, 21 preferably are perforation lines, although they may be other types of lines of weakness such as score lines, crease lines, etc. The fold lines 18, 19 may be lines of weakness if desired.

The intermediate 10 also comprises (see FIG. 1) a first pattern 24 of pressure activated cohesive comprising spaced distinct sealing elements 25 disposed adjacent the first end line 12 on the first face 16. The pressure activated cohesive preferably is as described above, such as more particularly described in the '128 patent, the other patents, commercial products, and pending application mentioned above.

The intermediate 10 also comprises a second pattern 26 of pressure activated cohesive including discrete spaced elements 27. The elements 25, 27 are positioned with respect to the intermediate 10 so that they cooperate with each other (that is they have substantially the same spacing from the side lines 14, 15 so that when the intermediate 10 is Z-folded about the fold lines 18, 19 (particularly about the fold line 18) the elements 25, 27, are in contact with each other and when then sent through an appropriate piece of processing equipment, such as a Moore SpeediSealer® sealing unit, a sealed edge of the mailer is formed. The elements 27 are adjacent the second fold line 19 on the first face 16.

As seen in FIG. 2, the intermediate 10 also comprises a third pattern of pressure activated cohesive comprising spaced discrete elements 29, disposed adjacent the second end line 13 on the second face 17, and a fourth pattern 30 comprising spaced discrete elements 31 disposed adjacent the first fold line 18 on the second face 17 (e.g. in the intermediate panel 18-19). The discrete elements 29, 31 are positioned with respect to each other (including particularly spaced from the side lines 14, 15) so that they engage and cooperate with each other to provide a sealing action when the intermediate 10 is Z-folded about the fold lines 18, 19 (particularly when folded about the line 19), coming into contact with each other and providing a seal once the intermediate is passed through a conventional sealing unit.

Figure 3:
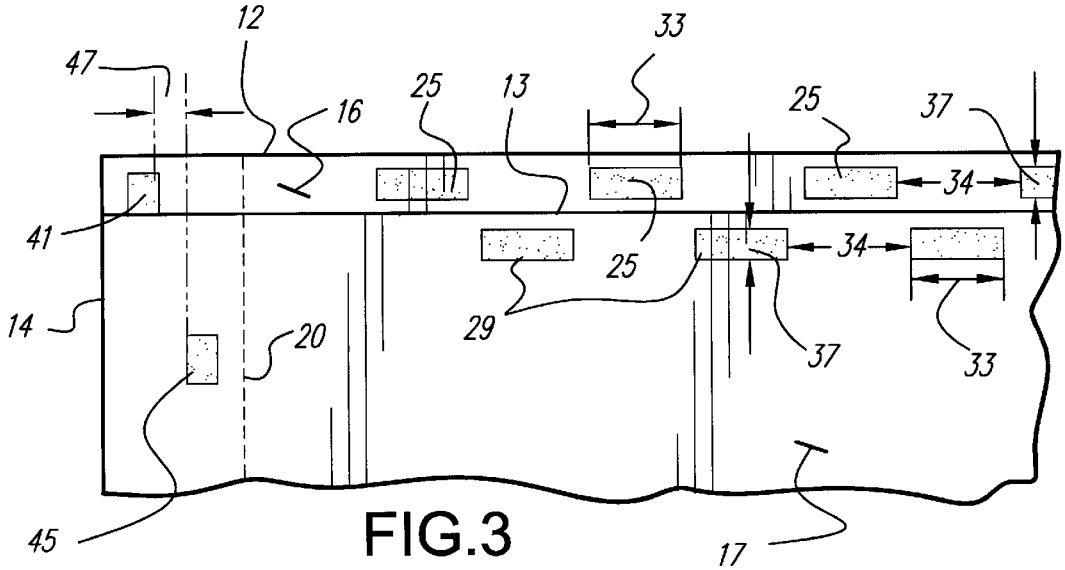
FIG. 3 is a schematic illustration indicating the substantial lack of overlap between the pressure activated cohesive elements of the intermediates of FIGS. 1 and 2 when in a roll or stack configuration.

The first and second pattern elements 25, 27 are shaped and dimensioned and positioned with respect to the third and fourth pattern elements 29, 31, so that they do not substantially overlap in roll or stack form/configuration. This is perhaps best seen with respect to the configuration in FIG. 3 which schematically illustrates the juxtaposition between the elements 25, 29 so that it is clear that they do not overlap.

In the preferred embodiment illustrated in the drawings, the elements 25, 27, 29, 31 are substantially rectangular in configuration, having a length dimension 33 (see FIG. 3) substantially parallel to the end lines/edges 12, 13. The length dimension 33, in the preferred embodiment, typically is between about 0.8–1 cm, e.g about 0.9 cm. The elements within any particular pattern (that is the elements 25 within the pattern 24, the elements 29 within the pattern containing the elements 29, etc.) are spaced from each other a distance 34 (see FIG. 3) parallel to the length dimension 33. The spacing 34 is preferably slightly greater than the dimension 33, although not so much so as to significantly interfere with the sealing action thereof. For example, in the preferred embodiment described above, for the dimension 33, the dimension 34 is between about 1.2–1.5 cm, e.g. about 1.3 cm.

Also, in the preferred embodiment illustrated, for the cooperating patterns 24, 26 and 28, 30, respectively, one set of elements 25, 27 and 29, 31 preferably has a width dimension (perpendicular to the length dimension 33) that is noticeably greater than the width dimension of the other, e.g. at least about 0.1 cm greater. For example, for the embodiment illustrated in the drawings, the elements 27 have a width dimension 36 of about 0.5 cm, whereas the elements 25 have a width dimension 37 of about 0.3 cm. Similarly, the elements 31 preferably have the width dimension 36, while the elements 29 have the width dimension 37. This provision of the increased width dimension 36 compared to the dimension 37 insures that there is sufficient engagement between the cooperating cohesive elements 25, 27 and 29, 31, respectively, even if the folding about the fold lines 18, 19 is not exact, and even if there are minor variations in the positioning of the elements 25, 27, 29, 31 during production of the intermediate 10.

The intermediate 10 also comprises fifth and sixth patterns of pressure activated cohesive 39, 40 comprising discrete elements 41, 42, respectively, disposed on the first face 16. The patterns 39, 40 are disposed adjacent the lines of weakness 20, 21 in the tear-off edges 22, 23, and each of the patterns 39, 40 is disposed in one or more than one panel so that the elements 41, 42 cooperate with each other when the intermediate 10 is Z-folded about the fold lines 18, 19 (particularly the fold line 18). Typically, the elements 41 and 42 are provided in the tear-off edges 22, 23 of the first panel 12-18, and the second panel 18-19, as illustrated in FIG. 1. Where the intermediate 10 is for a uniform Z-fold mailer, the elements 41, 42 traverse substantially the entire dimension of the panels 12-18, 18-19 in the dimension parallel to the side lines/edges 14, 15.

As seen in FIG. 2, the intermediate 10 also comprises seventh and eighth patterns of pressure activated adhesive 43, 44 formed in the tear-off edges 22, 23 adjacent the lines of weakness 20, 21 on the second face 17 of the intermediate 10. The patterns 43, 44 also are preferably formed by discrete elements 45, 46, respectively, which, in the preferred embodiment illustrated in FIG. 2, are disposed in the tear-off edges 22, 23 of the second and third panels 18-19, 19-13, the elements 45 cooperating with each other, and the elements 46 cooperating with each other, when the intermediate 10 is Z-folded about the fold line 19.

The elements 41, 42 and 45, 46 are dimensioned, configured, and positioned so that they substantially do not overlap each other when the intermediate 10 is in roll or stack form. This is primarily accomplished by providing a spacing therebetween in a dimension parallel to the end edges 12, 13, as seen by the reference numeral 47 in FIG. 3. That is, in the preferred embodiment the elements 41, 42 are disposed substantially immediately adjacent the side edges 14, 15, respectively, while the elements 45, 46 are disposed substantially immediately adjacent the lines of weakness 20, 21, respectively. For example, and example only, where the elements 41, 42, 45, 46 are rectangles of cohesive having a length dimension thereof parallel to the side edges 14, 15, they may each have a width dimension of between about 0.2–0.4 cm (e.g. about 0.3 cm) with a spacing 47 therebetween also between about 0.2–0.4 cm (e.g. about 0.3 cm).

Figure 4:
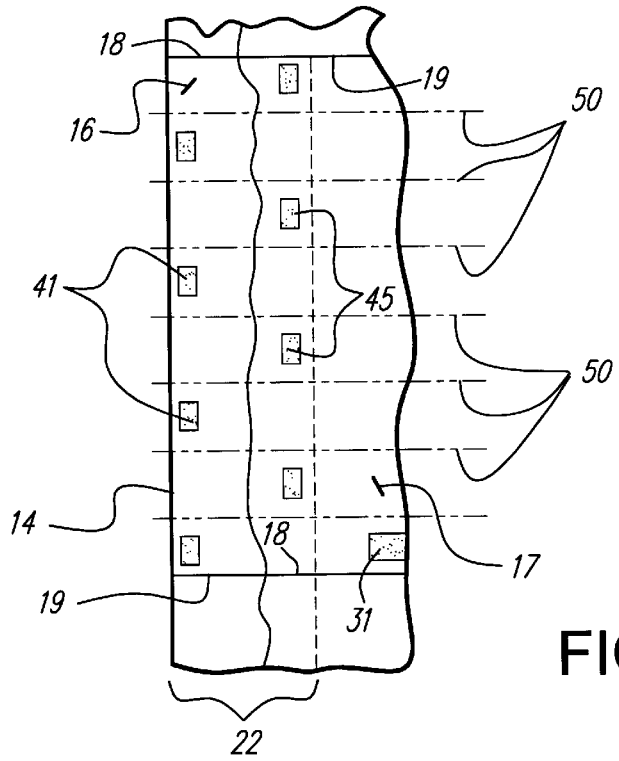
FIG. 4 is a view like that of FIG. 3 only showing the further lack of overlap in another dimension of the pressure activated cohesive elements in the second panels of two stacked or overlying business form intermediates according to the invention.

For the patterns 39, 40, 43, 44, a uniform configuration and length of the elements 41, 42, 45, 46, need not be exact, although close dimensioning is still desirable. Also, in order to assure even further the improbability of any significant overlap between elements while the intermediates 10 are in roll or stacked form, and also to prevent curling of the sheet 11', where the elements 45, 46 and 41, 42 are provided in the same panel (the intermediate panel 18-19 in the embodiment illustrated) it is also desirable to provide a spacing between them in an dimension parallel to the side edges 14, 15. This is seen most clearly in FIG. 4, where—merely for the purposes of illustration—one intermediate 10 is provided in a stack with a second face 17 facing upwardly, while another intermediate 10 underlying the first intermediate is provided with a face 16 facing upwardly, and in both cases the side edges 14 thereof are aligned. As seen in FIG. 4 by the line 50 perpendicular to the side edges 14 and extending between the elements 41, 45, there is substantially no overlap between the elements 41, 45. In fact in the particular embodiment illustrated, each of the elements 41, 45 (and thus also the elements 42, 46) may have a dimension (parallel to the side edge 14) of between about 0.5–0.7 cm (e.g. about 0.6 cm), with a spacing between the elements 41, and the same spacing between the elements 45, of about 1–1.5 cm (e.g. about 1.3 cm) with the elements 41 provided (on the opposite face) in the spacing between the elements 45.

Figure 5:
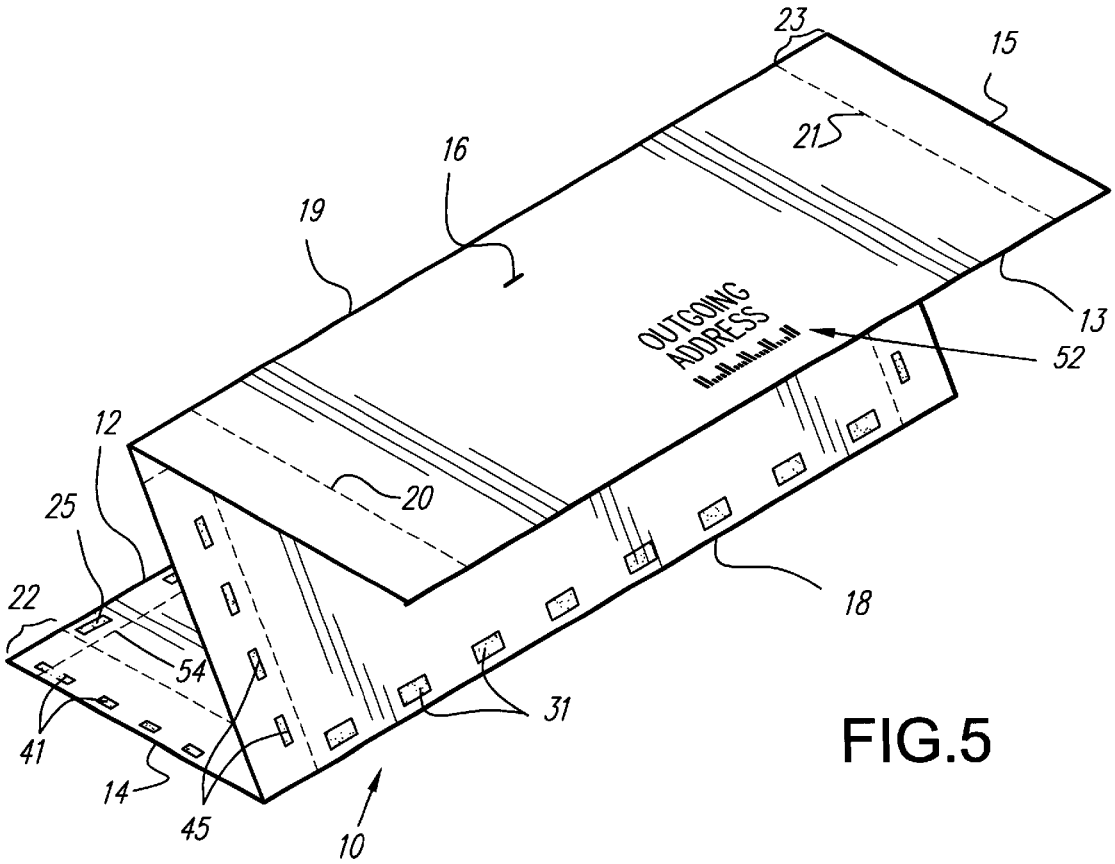
FIG. 5 is a schematic perspective view showing the intermediate of FIG. 2 being Z-folded about the fold lines thereof to form a mailer type business form.

In the preferred embodiment, the intermediate 10 has outgoing address indicia, preferably in both human and machine readable form, imaged (as provided by a label or the like) on the first face 16 of the third panel 19-13, as indicated schematically at 52 in each of FIGS. 1 and 5, preferably being upright when the end edge 12 is at the top. Indicia is also preferably provided on a wide variety of other panel faces of the intermediate 10, and preferably all of them, the indicia provided depending upon the particular function of the mailer, or desirable use thereof.

As seen in FIG. 5, the final mailer is produced by Z-folding (which may include eccentric Z-folding) of the intermediate 10 about the fold lines 18, 19 as illustrated to form a mailer with the outgoing address 52 on the outer face thereof, the intermediate 10 when Z-folded being passed through conventional sealing equipment to form the final sealed mailer. Inserts may be provided when desired.

The formation of the intermediate 10 according to the invention may be effected using conventional equipment for applying the cohesive patterns, lines of weakness, fold lines, etc. Also, where desired, additional lines of weakness, etc., may be provided. For example, the lines of weakness 53, 54, as illustrated in FIGS. 1, 2 and 5, also may be provided.

When the mailer is formed by Z-folding the intermediate 10 as illustrated in FIG. 5, the formed mailer is opened by tearing along the lines of weakness 20, 21 in order to remove the tear-off edges 23, and then tearing along the lines of weakness 53, 54, which are in alignment with each other. Tearing along the lines 53, 54 is preferably practiced after folding the mailer thereat in order to crease the portion of the intermediate panel 18-19 in alignment with the lines of weakness 53, 54, allowing complete detachment of each of the remaining portions of the panels 12-18, 18-19, 19-13 from each other.

It will thus be seen that according to the present invention a Z-fold type mailer business form intermediate is provided in which there is substantially no overlap between the cohesive elements thereof in roll or stack form, and which allows the utilization of particularly effective pressure sensitive cohesive such as shown in copending application Ser. No. 09/507,932, filed Feb. 22, 2000. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and devices.

What is claimed:

1. A Z-fold mailer business form intermediate comprising:

a sheet or web of paper having first and second faces, first and second end lines substantially parallel to each other, and first and second side lines substantially parallel to each other and substantially perpendicular to said first and second end lines;

first and second fold lines extending substantially parallel to each other and to said end lines for dividing said sheet or web between said end lines, into first, second and third panels;

first and second lines of weakness spaced from but adjacent and substantially parallel to said first and second side lines, defining first and second tear-off edges in a mailer produced from said intermediate;

a first pattern of pressure activated cohesive comprising spaced distinct sealing elements disposed adjacent said first end line on said first face, and a second pattern of pressure activated cohesive which cooperates with said first pattern when said intermediate is Z-folded about said fold lines to form a mailer;

said second pattern disposed adjacent said second fold line on said first face;

a third pattern of pressure activated cohesive comprising spaced distinct sealing elements disposed adjacent said second end line of said second face and a fourth pattern of pressure activated cohesive which cooperates with said third pattern when said intermediate is Z-folded about said fold lines to form a mailer, said fourth pattern disposed adjacent said first fold line on said second face;

said first and second pattern elements shaped and dimensioned and positioned with respect to said third and fourth pattern elements so that they substantially do not overlap in roll or stack form;

fifth and sixth patterns of pressure activated adhesive each comprising spaced distinct sealing elements disposed adjacent said first and second lines of weakness respectively in said tear-off edges on said first face and positioned so that the elements thereof cooperate with each other when said intermediate is Z-folded about said fold lines;

seventh and eighth patterns of pressure activated adhesive each comprising spaced distinct sealing elements disposed adjacent said first and second lines of weakness respectively on said second face and positioned so that the elements thereof cooperate with each other when said intermediate is Z-folded about said fold lines; and said fifth and seventh, and said sixth and eighth, patterns positioned and spaced from each other in a dimension substantially parallel to said end edges, and so that said patterns substantially do not overlap in roll form and do not overlap in stack form;

wherein at least the majority of said elements are rectangular in shape, having a length and width;

wherein said elements in at least some of said fifth through eighth patterns are spaced from each other a distance greater than said length.

2. An intermediate as recited in claim 1 wherein said elements in any of said first through fourth patterns are spaced from each other a distance greater than said length.

3. An intermediate as recited in claim 1 wherein said end lines are end edges, and said intermediate second side line is joined with a second intermediate.

4. An intermediate as recited in claim 1 wherein said end and side lines are end and side edges.

5. An intermediate as recited in claim 1 wherein said end lines are lines of weakness.

6. An intermediate as recited in claim 1 wherein said fifth and sixth patterns are provided in said first and second panel tear-off edges and said seventh and eighth patterns in said second and third panel tear-off edges.

7. An intermediate as recited in claim 1 wherein said fifth and sixth patterns are substantially immediately adjacent said first and second lines of weakness whereas said seventh and eighth patterns are spaced from said first and second lines of weakness a dimension greater than the width of said elements immediately adjacent said lines of weakness.

8. An intermediate as recited in claim 1 wherein said first, second and third panels all have substantially the same dimensions.

9. An intermediate as recited in claim 1 wherein said elements of said first through fourth patterns each have substantially the same length dimension substantially parallel to said end lines; and wherein said elements are spaced from each other in the direction of said length dimension a distance greater than said length dimension.

10. An intermediate as recited in claim 9 wherein said elements of said first through fourth patterns have a length dimension of between about 0.8–1 cm, and a spacing of between about 1.2–1.5 cm.

11. An intermediate as recited in claim 10 wherein said elements of one of each of said first and second patterns, and third and fourth patterns, has a width dimension at least about 0.1 cm greater than the other of said first and second, and third and fourth, patterns.

12. An intermediate as recited in claim 11 wherein said second and fourth pattern elements have a width dimension at least about 0.1 cm greater than said first and third pattern elements.

13. An intermediate as recited in claim 1 further comprising outgoing address indicia on said third panel first face.

14. An intermediate as recited in claim 1 wherein said seventh and eighth patterns are substantially immediately adjacent said first and second lines of weakness whereas said fifth and sixth patterns are spaced from said first and second lines of weakness a dimension greater than the width of said elements immediately adjacent said lines of weakness.

15. A Z-fold mailer business form intermediate comprising:

a sheet or web of paper having first and second faces, first and second end lines substantially parallel to each other, and first and second side lines substantially parallel to each other and substantially perpendicular to said first and second end lines;

first and second fold lines extending substantially parallel to each other and to said end lines for dividing said sheet or web between said end lines, into first, second and third panels;

first and second lines of weakness spaced from but adjacent and substantially parallel to said first and second side lines, defining first and second tear-off edges in a mailer produced from said intermediate;

a first pattern of pressure activated cohesive comprising spaced distinct sealing elements disposed adjacent said first end line on said first face, and a second pattern of pressure activated cohesive which cooperates with said first pattern when said intermediate is Z-folded about said fold lines to form a mailer;

said second pattern disposed adjacent said second fold line on said first face;

a third pattern of pressure activated cohesive comprising spaced distinct sealing elements disposed adjacent said second end line of said second face and a fourth pattern of pressure activated cohesive which cooperates with said third pattern when said intermediate is Z-folded about said fold lines to form a mailer, said fourth pattern disposed adjacent said first fold line on said second face;

said first and second pattern elements shaped and dimensioned and positioned with respect to said third and fourth pattern elements so that they substantially do not overlap in roll form and do not overlap in stack form;

said elements of said first through fourth patterns each having substantially the same length dimension substantially parallel to said end lines; and wherein said elements are spaced from each other in the direction of said length dimension a distance greater than said length dimension.

16. An intermediate as recited in claim 15 wherein said elements of said first through fourth patterns have a length dimension of between about 0.8–1 cm, and a spacing of between about 1.2–1.5 cm.

17. An intermediate as recited in claim 16 wherein said elements of one of each of said first and second patterns, and third and fourth patterns, have a width dimension at least about 0.1 cm greater than the other of said first and second, and third and fourth, patterns.

18. An intermediate as recited in claim 17 wherein said second and fourth pattern elements have a width dimension at least about 0.1 cm greater than said first and third pattern elements; and further comprising outgoing address indicia on said third panel first face.

* * * * *